United States Patent [19]

Sjölund

[11] 4,247,082

[45] Jan. 27, 1981

[54] FLUID JACK AND LOCKING DEVICE

[75] Inventor: Åke G. Sjölund, Sollentuna, Sweden

[73] Assignee: AB Resmastservice, Skövde, Sweden

[21] Appl. No.: 40,269

[22] Filed: May 18, 1979

[30] Foreign Application Priority Data

May 29, 1978 [SE] Sweden ..... 7806127

[51] Int. Cl.[3] ..... B66F 3/30

[52] U.S. Cl. ..... 254/93 R; 92/13.8; 92/23; 92/136

[58] Field of Search ..... 92/13.8, 23, 136; 254/93 R, 93 H

[56] References Cited

U.S. PATENT DOCUMENTS

| | | | |
|---|---|---|---|
| 2,284,958 | 6/1942 | Grime | 254/93 H |
| 2,408,181 | 9/1946 | Simonton | 254/93 R |
| 3,317,186 | 5/1967 | Brandt | 254/93 R |
| 3,321,182 | 5/1967 | Elenburg | 254/93 R |
| 3,658,297 | 4/1972 | Banks . | |

FOREIGN PATENT DOCUMENTS

| | | |
|---|---|---|
| 646110 | 11/1928 | France . |
| 214238 | 7/1967 | Sweden . |
| 333304 | 3/1971 | Sweden . |

*Primary Examiner*—Robert C. Watson

*Attorney, Agent, or Firm*—Pollock, Vande Sande & Priddy

[57] ABSTRACT

A jack comprising a cylinder and a piston, the piston being reciprocal in the cylinder by means of pressure fluid. A piston rod extends out through an end wall of the cylinder. An abutment is fixed to the cylinder or connected to the piston rod. A restricting member, connected to the piston rod or the cylinder, is axially displaceable thereon for engagement with the abutment in any relative position between the piston and the cylinder. A locking device can be connected to the cylinder or the restricting member to lock the latter when engaging the abutment.

11 Claims, 2 Drawing Figures

FLUID JACK AND LOCKING DEVICE

The present invention relates to a jack comprising a cylinder and a piston which is reciprocal in the same by means of a pressure medium and which has a piston rod extending out through an end wall of the cylinder.

Jacks of this kind can be used to secure an article to a base in which the cylinder and piston rod of the jack are coupled to the article and base, respectively, and the article is kept pressed in an unmovable position against the base by means of a tension or pressure force which is generated by the pressure fluid being fed into the cylinder at one side of the piston.

Jacks of this type can, for example, be used to secure loads such as containers on platforms, to batten down the hatches on ships and the like.

During latter years it has also become usual to transport on the decks of ships or tow boats very heavy articles up to 20,000 tons, e.g., platforms for drilling for oil. These heavy articles must be very securely fastened to the base in order to avoid displacement during transport by sea. Up to now this anchorage has usually been achieved by the article being welded to the deck and to supports arranged on the deck. This, however, has considerable disadvantages. The welding takes time, and is expensive, and necessitates the use of a cutting torch to remove the welded connections at the place of destination, which is likewise expensive and time-consuming. If the destination is an oil drilling rig or other place situated at sea, a further problem arises in that the transport is dependent on weather conditions, relatively calm weather being essential during the entire time it takes to release the article, and an unexpected turn for the worse in the weather after the article has been partly loosened can result in a catastrophe.

Previous suggestions to use hydraulic jacks for securing articles, especially during transport on the high seas, have, however, been abandoned for the reason that the necessary clamping power could not be guaranteed with assurance as it is dependent on hydraulic pressure which can drop through leakage or totally disappear through pipe failure, or the like.

The present invention is intended to produce a jack which can be locked mechanically after the necessary tension or pressure force has been achieved in a hydraulic manner, so that said force remains constant independent of the hydraulic pressure. At the same time it renders it possible to provide and remove the mechanical locking with ease and comparative speed.

Figure 1:
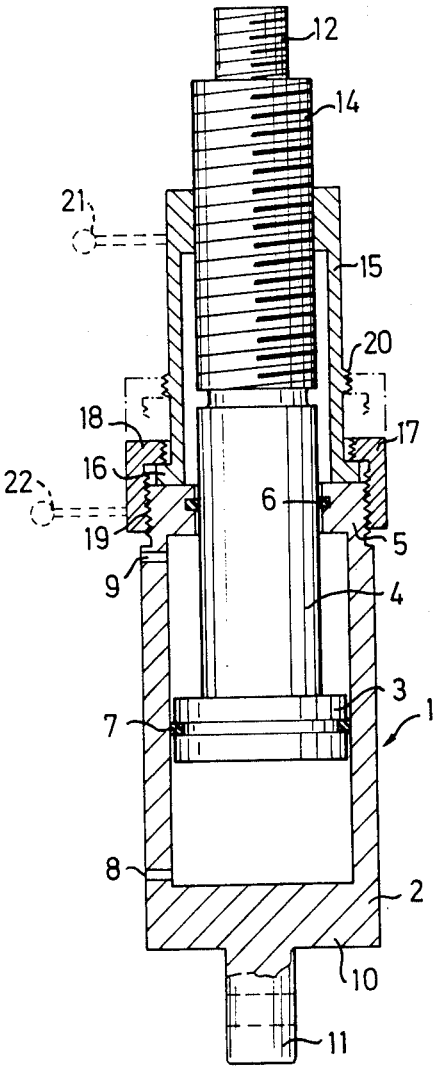

Two suitable embodiments of the jack according to the invention will now be described, and are illustrated in the accompanying drawings, of which FIG. 1 shows a first embodiment in axial section, and FIG. 2 in like manner shows a second embodiment.

In both embodiments, the hydraulic part of the jack 1 in a known manner comprises a cylinder 2 and in said cylinder a reciprocable piston 3 having a piston rod 4 which extends out through one end wall 5 of the cylinder 2. The passage of the piston rod is sealed by means of a conventional packing box 6 which is only shown schematically and is adapted to the desired maximum pressure. The piston 3 is also provided with a conventional piston seal 7. In a known manner, the cylinder 2 is equipped with ports 8 and 9 for the supply and drainage of the pressure fluid to and from the spaces on both sides of the piston 3, so that the jack is double-acting. The closed end wall 10 of the cylinder 2 and the free end of the piston rod 4 are furthermore provided with means by the help of which said elements can be connected to an article and a base, respectively. Said means may be of any suitable form and are shown as an attachment ring 11 on the cylinder 2 and a threaded end piece 12 of the piston rod 4.

In the embodiment according to FIG. 1, the end of the piston rod 4 protruding from the cylinder 2 is provided with an externally threaded portion 14. A tubular sleeve 15, serving as a restricting means and being provided with an internal thread, is screwed on to the threaded portion 14 of the piston rod 4 and extends towards the adjacent end wall 5 of the cylinder 2, so that the tubular sleeve 15 surrounds the piston rod 4 without abutting against the same. At the end facing the cylinder, the tubular sleeve 15 is provided with an annular flange 16 which extends radially and has a flat end surface.

A nut 17, serving as a locking means, is passed over the tubular sleeve 15 and has an annular flange 18 which is directed radially inwards and arranged at the end of the nut facing away from the cylinder 2. The nut 17 is intended to cooperate with an external thread 19 at the adjacent end of the cylinder 2.

In between its ends the tubular sleeve 15 is furthermore provided with a short male threaded portion 20 which is intended to cooperate with a female thread at the annular flange 18 of the nut 17 when the nut is not screwed on to the thread 19 of the cylinder 2.

The jack according to FIG. 1 is used in the following manner.

The jack is connected to the article which is to be secured and to the base for the article by means of the connecting means 11,12. The nut 17 is thereby attached to the tubular sleeve 15 over the threaded portion 20 thereof, as shown in phantom lines. Upon introduction of pressure fluid to the cylinder at either side of the piston 3, the necessary clamping tension or pressure force is developed between the article and the base.

While maintaining the hydraulic pressure in the cylinder 2, the tubular sleeve 15 is rotated by means of a handle 21, for example, and is thereby screwed along the threaded portion 14 of the piston rod 4 until the end of the tubular sleeve 5, having the external annular flange 16, is forcefully pressed against the adjacent end wall 5 of the cylinder 2. Thereafter the nut 17 is also turned, by means of the handle 22, so that it is screwed out of the threaded portion 20 of the tubular sleeve 15 and thereafter onto the thread 19 of the cylinder 2. The nut 17 is tensioned so that its internal annular flange 18 is heavily pressed against the external annular flange 16 of the tubular sleeve 15. The jack is thereby mechanically locked at the desired tension or pressure force, in that the displacement of the piston 3 in one direction is prevented through the abutment of the tubular sleeve 15 against the end wall 5 of the cylinder 2 and in the opposite direction in that the nut flange 18 abuts against the sleeve flange 16. The pressure fluid introduced can thereafter be extracted if desired without changing the force exerted by the jack. The clamping force is removed by turning the nut 17 and the tubular sleeve 15 in the opposite direction after reintroduction of the fluid pressure in the cylinder 2.

Figure 2:
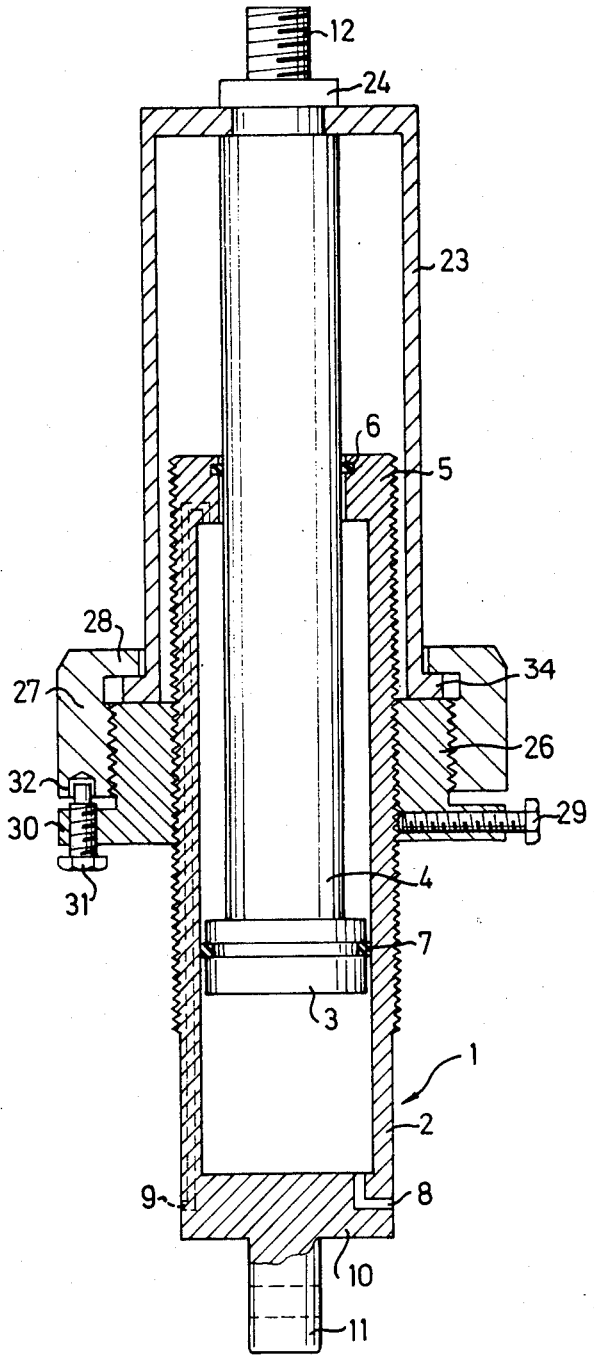

The embodiment according to FIG. 2 substantially corresponds to that described above. It also includes a tubular sleeve 23 but this acts as a fixed abutment means corresponding to the end wall 5 of the cylinder 2 in the embodiment according to FIG. 1. The tubular sleeve 23 is rotatably but axially indisplaceably connected to the piston rod 4, preferably by engagement between a radial abutment surface of the piston rod 4 and a stop ring 34 attached thereto. The tubular sleeve 23 extends over the piston rod end of the cylinder 2 without contacting the same and a radial, external, annular flange 24 is arranged at the free end thereof and has a flat radial end surface forming said fixed abutment means.

The cylinder 2 is provided with a male thread which cooperates with a female thread of an annular member 26. By turning, said annular member 26 can thus be axially displaced along the cylinder 2 and with a flat end surface be pressed against the flat end surface of the tubular sleeve 23, whereby the annular member 26 serves as a restricting means in like manner to the tubular sleeve 15 of the embodiment according to FIG. 1.

The annular member 26 also has a male thread which is intended to cooperate with a nut 27 serving as a locking means. The nut 27 is passed over the tubular sleeve 23 and has an annular flange 28, which is directed radially inward and is pressed into abutment with the external annular flange 34 of the tubular sleeve 23, when the nut 27 is screwed on to the male thread of the annular member 26 and is tightened.

The jack according to FIG. 2 is used in the same manner as the jack according to FIG. 1. When the desired tension or pressure force has been achieved by introduction of pressure fluid into the cylinder 2, the annular member 26 is displaced by turning so far along the cylinder 2 that the end surface thereof is forcefully pressed against the end of the tubular sleeve 23 having the annular flange 34. Thereafter the nut 27 is screwed on to the male thread of the annular member 26 and tightened, so that the internal annular flange 28 is pressed against the annular flange 24 of the tubular sleeve 23. The jack is thereby mechanically locked in the position corresponding to the desired clamping force and the hydraulic pressure in the cylinder 2 can be removed if desired.

In order to further secure the jack in the desired position, the annular member 26 may be provided with a radially extending locking screw 29, the end of which can be pressed into locking engagement with the outer surface of the cylinder 2. At the edge turned away from the cylinder 2, the annular member may furthermore be provided with a radial, external annular flange 30 having an axial threaded bore for a second locking screw 31, the end of which may be inserted into one of a number of blind holes 32 in the adjacent end surface of the nut 27, or may only be pressed into locking engagement with said end surface. These two locking screws 29,31 prevent unintentional turning of the annular member 26 and the nut 27, respectively.

Between its ends, the tubular sleeve 23 may furthermore comprise a short threaded portion (not shown) corresponding to the threaded portion 20 of the embodiment according to FIG. 1 and intended to cooperate with a female thread on the annular flange 28 of the nut 27 to support the nut 27 when the same is not threaded on to the annular member 26.

The annular member 26 and the nut 27 may also be provided with handles (not shown) corresponding to the handles 21,22 of the embodiment according to FIG. 1.

By the aid of any one of the jacks described above, the desired clamping force can thus be achieved by means of introduction of pressure fluid into the cylinder 2 of the jack and the jack may thereafter be mechanically locked in a position corresponding to the desired clamping force, so that this force is maintained independent of the hydraulic pressure. The locking of the jack may furthermore be achieved or removed in a rapid and simple manner, so that the time required to secure and release the article is comparatively short.

What I claim is:

1. A double-acting jack comprising (a) a cylinder (2);

(b) a piston (3) reciprocable in said cylinder by means of a pressure medium and having a piston rod (4) extending through an end wall (5) of said cylinder;

(c) a portion of said piston rod (4) protruding from said cylinder (2) being coaxially surrounded by a tubular sleeve (15; 23) having a first end connected to said piston rod (4) at a distance from said end wall (5) of said cylinder (2), a second end of said sleeve (15; 23), facing said cylinder (2), being arranged for engagement in all possible positions of said piston (3) relative to said cylinder (2) with an abutment surface connected to said cylinder (2), said tubular sleeve (15; 23), upon engagement with said abutment surface, preventing retraction of said piston rod (4) into said cylinder; and (d) a locking element (17; 27) connectable to said cylinder (2) for loading said tubular sleeve (15; 23) in the position of engagement, and preventing extension of said piston rod (4) out of said cylinder when it engages said sleeve.

2. A jack as claimed in claim 1, wherein said first end of said tubular sleeve (15) is connected to said piston rod (4) by means of threads, said abutment surface cooperating with said second end of said sleeve (15) comprising the end surface of said end wall (5) surrounding said piston rod, said second end of said sleeve (15) being engageable with said abutment surface by rotating said sleeve (15) relatively to said piston rod.

3. A jack as claimed in claim 1, wherein said first end of said tubular sleeve (23) is axially indisplaceably but rotatably connected to said piston rod (4) and said second end thereof surroundingly overlaps the piston rod end of said cylinder (2), said abutment surface cooperating with said second end comprising an end surface of an annular element (26) having an internal thread for cooperation with an external thread of said cylinder (2), whereby to bring said abutment surface into engagement with said second end of said sleeve (23) by rotation of said annular member (26) relatively to said cylinder (2).

4. A jack as claimed in claim 3, wherein said second end of said tubular sleeve (15; 23) has an external annular flange (16; 24), said locking element comprises a nut (17; 27) which is screwable onto said cylinder (2) and said annular element (26), respectively, and said nut has an internal annular flange (18; 28) which overlaps said external annular flange (16; 24) of said sleeve (15; 23) and retains the same in engagement with said end wall (5) and said end surface of said annular element (26), respectively.

5. A jack as claimed in claim 4, wherein said internal annular flange (18; 28) of said nut (17; 27) is provided with an internal thread intended to cooperate with a short externally threaded portion (20) of said tubular sleeve (15; 23) when said nut is not threaded onto said cylinder (2) and said annular member (26), respectively.

6. A jack as claimed in claim 5, comprising a lock screw (29) radially threaded into said annular element

(26) and adjustable into locking engagement with the outer surface of said cylinder.

7. A jack as claimed in any one of claims 4 to 6 wherein said annular element (26) at the edge thereof spaced from said tubular sleeve (23) has an external annular flange (36) having an axially extending lock screw (31), whose free end is lockingly engageable with one of a plurality of blind holes (32) in the adjacent end surface of said nut (27) or with said end surface.

8. A jack as claimed in claim 2, wherein said tubular sleeve (15) is provided with a turning handle (21).

9. A jack as claimed in claim 3, wherein said annular element (26) is provided with a turning handle.

10. A jack as claimed in claim 4, wherein said nut (17; 27) is provided with a turning handle (22).

11. A jack comprising (a) a cylinder (2);

(b) a piston (3) reciprocable in said cylinder by means of a pressure medium and having a piston rod (4) extending through an end wall (5) of said cylinder;

(c) a portion of said piston rod (4) protruding from said cylinder (2) being coaxially surrounded by tabular sleeve (15; 23) having a first end connected to said piston rod (4) at a distance from said end wall (5) of said cylinder (2), a second end of said sleeve (15; 23), facing said cylinder (2), being arranged for engagement in all possible positions of said piston (3) relative to said cylinder (2) with an abutment surface connected to said cylinder (2);

(d) a locking element (17; 27) connectable to said cylinder (2) for loading said tubular sleeve (15; 23) in the position of engagement;

(e) said first end of said tubular sleeve (23) being axially indisplaceably but rotatably connected to said piston rod (4) and said second end thereof surroundingly overlapping the piston rod end of said cylinder (2); and (f) said abutment surface cooperating with said second end comprising an end surface of an annular element (26) having an internal thread for cooperation with an external thread of said cylinder (2), whereby to bring said abutment surface into engagement with said second end of said sleeve (23) by rotation of said annular member (26) relatively to said cylinder (2).

* * * * *